US007641520B2

(12) United States Patent
Marino

(10) Patent No.: US 7,641,520 B2
(45) Date of Patent: Jan. 5, 2010

(54) FLEXIBLE CONNECTOR ASSEMBLY

(75) Inventor: Jay C. Marino, South Euclid, OH (US)

(73) Assignee: PMI Industries, Inc., Cleveland, OH (US)

( * ) Notice: Subject to any disclaimer, the term of this patent is extended or adjusted under 35 U.S.C. 154(b) by 386 days.

(21) Appl. No.: 11/661,480

(22) PCT Filed: Aug. 26, 2005

(86) PCT No.: PCT/US2005/030427

§ 371 (c)(1),
(2), (4) Date: Feb. 27, 2007

(87) PCT Pub. No.: WO2006/026439

PCT Pub. Date: Mar. 9, 2006

(65) Prior Publication Data

US 2008/0009198 A1 Jan. 10, 2008

Related U.S. Application Data

(60) Provisional application No. 60/605,190, filed on Aug. 27, 2004.

(51) Int. Cl.
*H01R 24/04* (2006.01)

(52) U.S. Cl. ..... 439/668

(58) Field of Classification Search ..... 439/668, 439/669, 271, 218, 46, 48, 359
See application file for complete search history.

(56) References Cited

U.S. PATENT DOCUMENTS 5,352,126 A 10/1994 Kuboshima et al.
5,645,450 A 7/1997 Yamada et al.
6,295,475 B1 * 9/2001 Morgan ..... 607/122
6,705,900 B2 * 3/2004 Sommer et al. ..... 439/668
6,755,694 B2 * 6/2004 Ries et al. ..... 439/668
6,854,994 B2 * 2/2005 Stein et al. ..... 439/218
6,921,295 B2 * 7/2005 Sommer et al. ..... 439/668
7,052,297 B2 * 5/2006 Panzar et al. ..... 439/169
7,241,180 B1 * 7/2007 Rentas Torres ..... 439/668
7,287,995 B2 * 10/2007 Stein et al. ..... 439/218
7,326,083 B2 * 2/2008 Mehdizadeh et al. ..... 439/608
2004/0209516 A1 10/2004 Burris et al.

OTHER PUBLICATIONS

Cooper Crouse-Hinds, Electro Products catalog, pp. 10 and 11, Mar. 1988; and Amron International catalog, Browse Brands-Crouse Hinds Connectors, one page, 2003-2005. U.S.
Underwater Systems, Inc. brochure, two pages, Jul. 1993. U.S.
PCT Application No. PCT/US05/30427 International Search Report, dated Aug. 9, 2006, 3 pages.

* cited by examiner

*Primary Examiner*—Chandrika Prasad
(74) *Attorney, Agent, or Firm*—Fay Sharpe LLP

(57) ABSTRACT

The present invention is directed to a linear connector assembly comprising a plug connector (22) and a receptacle connector (24). The plug connector (22) includes an elongated member (26), and an electrical contact (72) disposed about a portion of the elongated member. The receptacle connector (24) includes a wall defining a cavity (44) dimensioned to sealingly receive the elongated member, and an electrical contact having a surface disposed in the wall for electrical connection with the plug contact. The electrical contacts of the plug connector (22) and the receptacle connector (24) have spherical surface portions whereby a spherical interlace between the electrical contacts is formed upon make-up and reduces voltage drops between the contacts.

25 Claims, 11 Drawing Sheets

FLEXIBLE CONNECTOR ASSEMBLY

This application is the U.S. national filing of PCT Application Serial No. PCT/US/2005/030427, filed Aug. 26, 2005, which claims the benefit of U.S. Provisional Application Ser. No. 60/605,190, filed Aug. 27, 2004, the disclosure of which is incorporated herein by reference.

BACKGROUND OF THE INVENTION

The present disclosure relates to a connector assembly and more particularly to a flexible connector assembly for an implantable wiring harness. However, it is to be appreciated that the present invention is also amenable to other like environments and applications.

The need for implantable mechanical assist or replacement organs and devices is growing at a fast pace that challenges the ability of the medical industry to develop, test, and commercialize suitable products. While innovative advances in materials, electronics, and technology propel this industry forward, the reliance on conventional approaches to the implantable wiring harnesses that connect these many devices together presents serious obstacles to reliability and implantability.

Implanted wiring harnesses are subjected to a spectrum of forces and environmental stresses that must be withstood throughout the lifetime of the device.

Moreover, as the sophistication and complexity of implanted medical devices increases, there is a corresponding increase in the number of separate power and control channels required in the wiring harness. These wiring harnesses must provide a safe and reliable conduit for electrical power, control signals, and feedback signals to and from power sources, control modules, sensors, and the necessary medical devices. In addition, they must be biocompatible, extremely reliable, easy to install and to replace, and they must be of small enough volume and flexible so as to not detract from patient comfort.

Conventional implantable wiring harness technology relies upon plastic-insulated metallic conductors cabled within a medical grade plastic jacket for the primary conduit. Interconnects are either hardwired at sealed devices (fixed and non-removable) or rely upon conventional connector approaches. These approaches have been adapted from other industries—essentially round rigid bodies with cylindrical coplanar pin and socket inserts packaged in bulky sealed enclosures.

Until recently, very few electrical devices were designed for long term implantation inside the human body. The classic example of implanted wiring is the pacemaker lead. This was once a very troublesome component, although the field has now progressed to a very high degree of reliability. While highly flexed, this application has some advantages. Generally, one lead wire has been involved, with current return through the body to the case of the pulse generator. Most advantageously, the current levels are extremely low, and exotic alloys can be used to construct the lead. These can be very strong and corrosion resistant, but of relatively high resistance. This resistance is insignificant to a pacemaker pulse, but is not as desired to a significant current carrying lead, such as occurs in implanted blood pumps.

Accordingly, the present invention provides a new and improved connector assembly for implanted medical devices which overcomes difficulties with the prior art while providing better and more advantageous overall results.

BRIEF DESCRIPTION OF THE INVENTION

A preferred linear connector assembly comprises a plug connector and a receptacle connector. The plug connector includes an elongated member and an electrical contact disposed about a portion of the elongated member. The receptacle connector includes a wall defining a cavity dimensioned to sealingly receive the elongated member and an electrical contact having a surface disposed in the wall for electrical connection with the plug contact. The electrical contacts of the plug connector and the receptacle connector have spherical surface portions whereby a spherical interface between the electrical contacts is formed upon make-up and reduces voltage drops between the contacts.

The elongated connector body includes a plurality of longitudinally spaced apart first electrical contacts fixedly secured to a peripheral surface of the elongated connector body. A plurality of longitudinally spaced apart second electrical contacts extend from the receptacle connector wall and at least partially surround the cavity. The plurality of second contacts are received electrically connected to the plurality of first contacts when the plug connector is received in the receptacle connector. Upon insertion of the elongated connector body into the cavity, the peripheral surface of the elongated connector body located between adjacent first contacts sealingly engages the wall to electrically isolate adjacent first contacts from each other.

The elongated plug connector includes a bore for receiving a first set of power and sensor cables. A plurality of spaced apart first electrical contacts are received in the bore, wherein the first set of power and sensor cables are electrically connected to the plurality of first electrical contacts. A plurality of second electrical contacts in the receptacle connector are received electrically connected to the plurality of first contacts upon assembly of the plug connector to the receptacle connector. A second set of power and sensor cables are electrically connected to the plurality of second electrical contacts. The second set of receptacle power and sensor cables are helically coiled about the cavity for flexibility and for relieving strain from solder joints between each second cable and each second electrical contact.

A benefit of the present invention resides in the ability to provide a totally flexible system of minimal volume that can provide the required reliability and implantability to maximize patient quality of life.

Another benefit of the present invention resides in the ability to provide electrical contacts which are relatively large, for good conduction, and sealed from one another, as a second barrier to shorting by fluid or corrosion.

Yet another benefit of the present invention resides in the ability to provide a connector assembly having minimized dimensions to ease implantability and improve patient comfort.

Still other non-limiting benefits and aspects of the invention will become apparent from a reading and understanding of the description of the preferred embodiments below.

BRIEF DESCRIPTION OF THE DRAWINGS

The present invention may take physical form in certain parts and arrangements of parts, several embodiments of which will be described in detail in this specification and illustrated in the accompanying drawings which form a part of the invention.

FIG. 4(*a*) is a partial enlarged view of FIG. 4 illustrating a spherical interface between electrical contacts of the plug connector and electrical contacts of the receptacle connector.

DETAILED DESCRIPTION OF THE PREFERRED EMBODIMENTS

Figure 1:
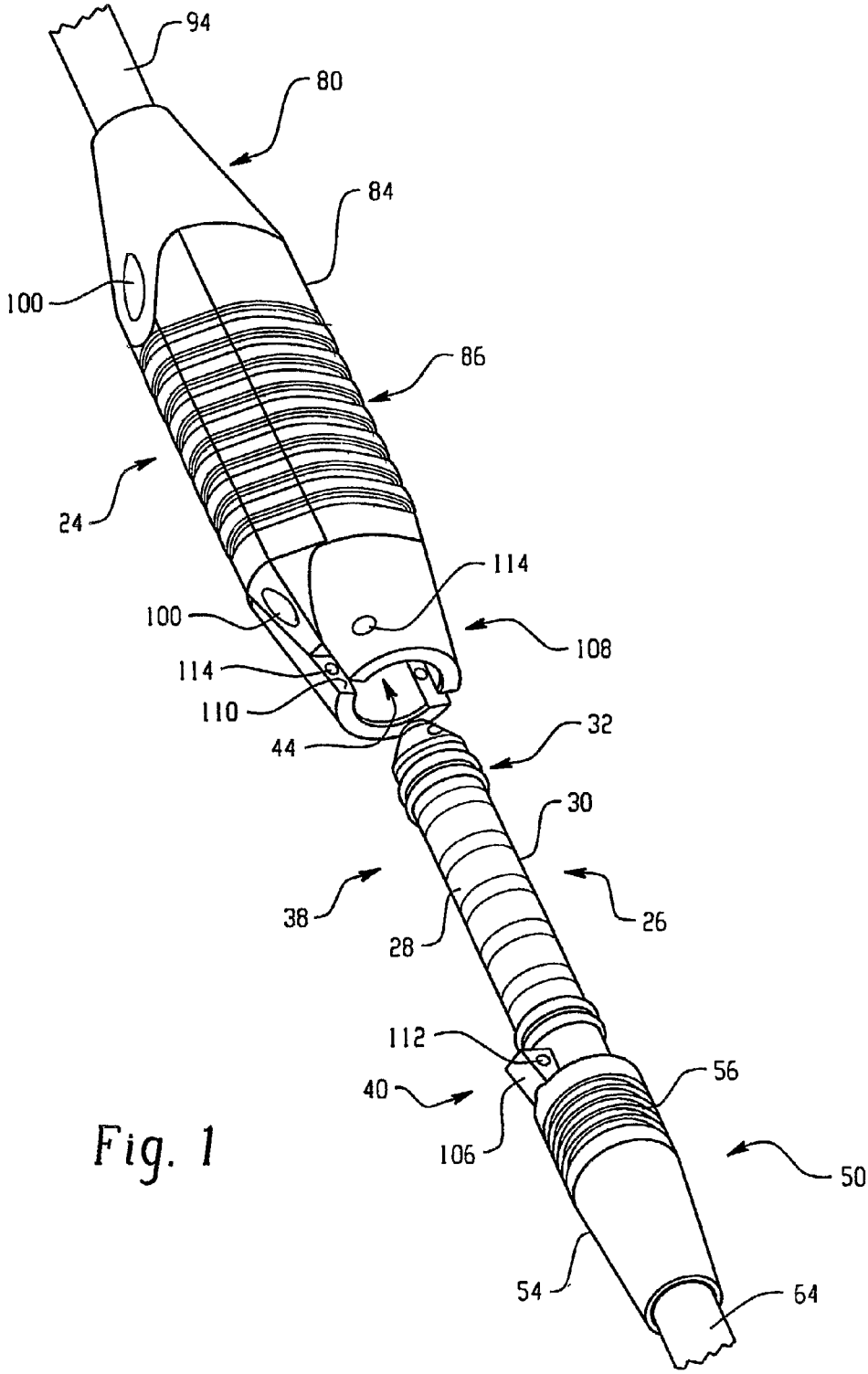
FIG. 1 is a perspective view of a plug connector and a receptacle connector of a connector assembly in accordance with a first embodiment of the present invention.
Figure 2:
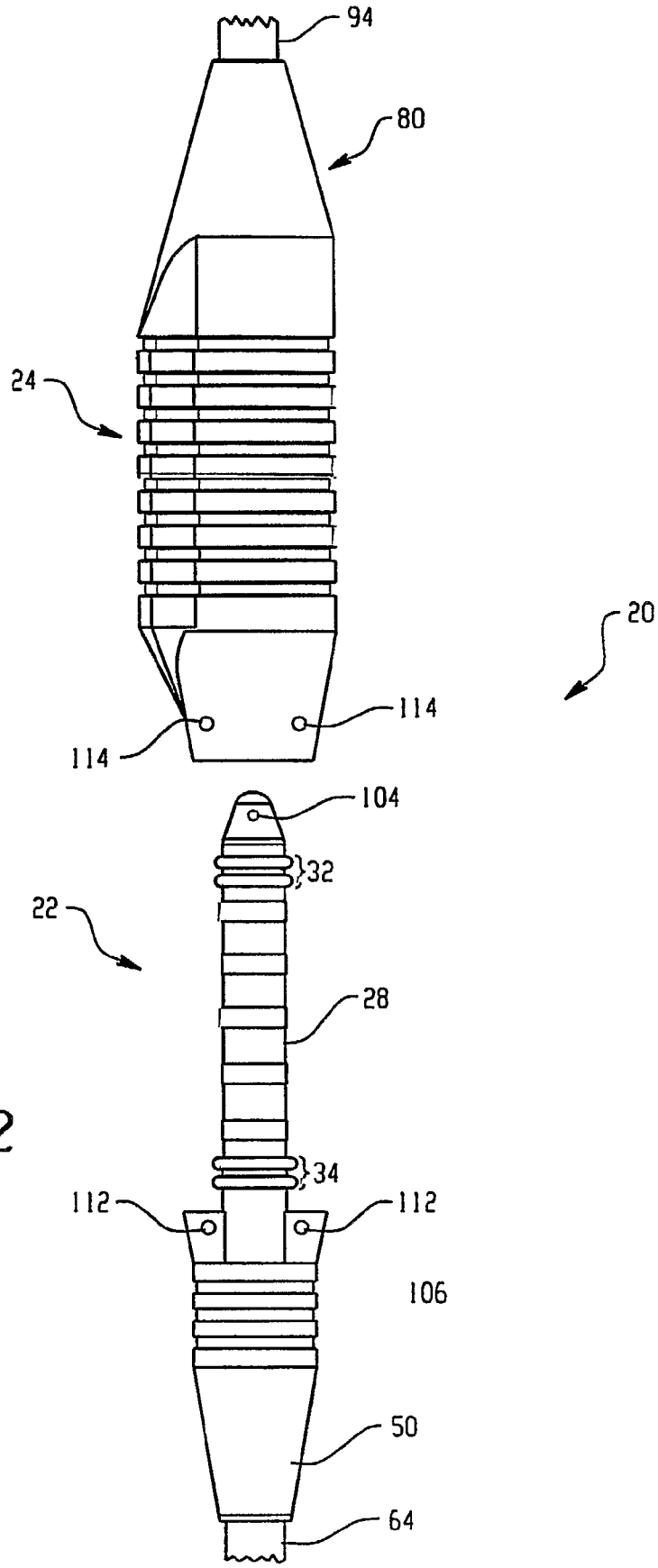
FIG. 2 is a side elevational view of the connector assembly of FIG. 1.

It should, of course, be understood that the description and drawings herein are merely illustrative and that various modifications and changes can be made in the structures disclosed without departing from the spirit of the invention. Like numerals refer to like parts throughout the several views. With reference to FIGS. 1 and 2, a generally linear flexible connector assembly 20 in accordance with a first embodiment of the present invention comprises a plug connector 22 and a receptacle connector 24. Both the plug connector and receptacle connector are formed at least partially from a flexible elastomeric material, preferably a medical grade elastomeric material.

Figure 3:
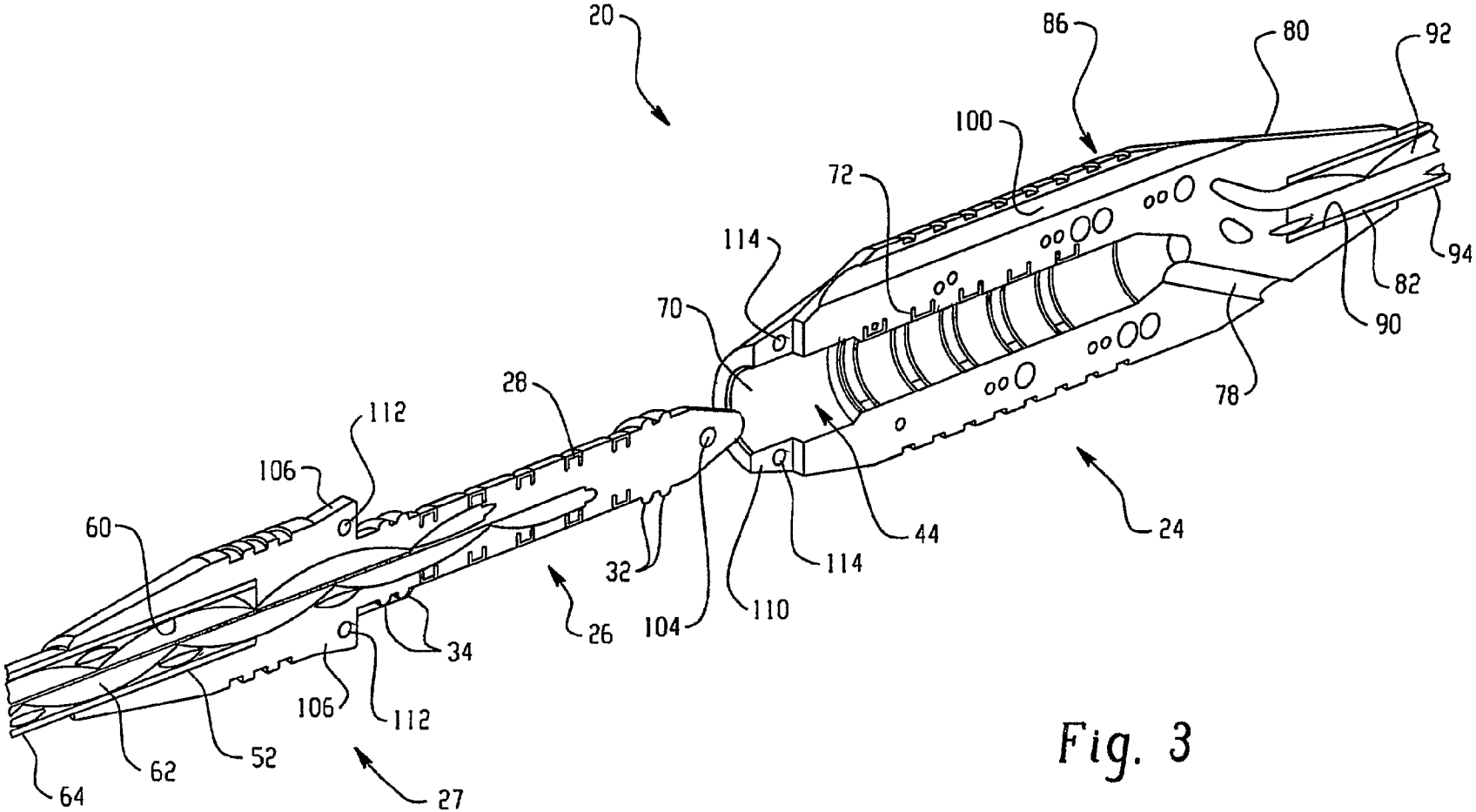
FIG. 3 is a cross-sectional view of the connector assembly of FIG. 2.

The plug connector 22 includes an elongated member 26 and at least one electrical contact. In this embodiment, the plug connector includes five longitudinally spaced apart electrical contacts 28 disposed about a portion of the elongated member; however, it should be appreciated that the plug connector 22 can include more or less than five electrical contacts depending on the manner and use of the connector assembly 20. Each electrical contact 28 is fixedly secured to a peripheral surface 30 of the elongated member and, as shown in FIG. 3, are generally circular in the preferred embodiment.

With continued reference to FIGS. 1 and 2, the plug connector 22 further includes a first or proximal seal 32 and a second or distal seal 34 axially spaced therefrom. The proximal seal is fixedly secured to a proximal portion 38 of the elongated member 26 and the distal seal distal is fixedly secured to a distal portion 40 of the elongated member. As will be described in greater detail below, the proximal seal 32 expels any fluid or air in a cavity 44 of the receptacle connector 24 upon advancement of the plug connector 22 into the receptacle connector. The distal seal 34 provides protection from fluid ingress and/or migration at tissue interfaces. In this embodiment, the proximal and distal seals are shown as a pair of adjacent seals having O-ring conformations. It will be appreciated that other contours of the proximal and distal seals 32, 34 can be used without departing from the scope of the present invention. As shown in FIG. 3, the proximal seal 32 and the distal seal 34 can be integrally formed with the elongated member 26.

Adjacent the distal portion of the elongated member 26 is a tapered strain relief 50 which adds flexibility to the plug connector 22. The strain relief also sealingly secures the plug connector to a first cable/cord jacket 52 (FIG. 3). In this embodiment, the strain relief is molded to the jacket, although, the jacket may be secured thereto with any other type of bonding. Disposed on a peripheral surface 54 of the strain relief is a gripping means 56 generally comprised of a plurality of axially-spaced, circumferentially extending ridges which allows for easy handling of the plug connector 22 and provides a user with a suitable gripping surface for make-up and disconnection of the connector assembly. With reference now to FIG. 3, the plug connector 22 includes a bore 60 for receiving a first set of power and signal/sensor cables 62 extending from an end of a cord 64. Each power and signal/sensor cable is electrically connected to one of the electrical contacts 28. The power and signal/sensor cables 62 extend longitudinally through the elongated member 26, the elastomeric material of the elongated member at least partially encapsulating the cables.

With reference again to FIGS. 1 and 3, the receptacle connector 24 includes a wall 70 defining the cavity 44 which, as stated above, is dimensioned to sealingly receive the elongated member 26. The receptacle connector further includes at least one electrical contact having a surface disposed in the wall 70 for electrical connection with at least one of the electrical contacts 28 of the plug connector. Preferably, the receptacle connector will have the same number of electrical contacts as the plug connector 22 and, in this embodiment, the receptacle connector has five longitudinally spaced apart electrical contacts 72 extending from the wall 70 and at least partially surrounding the cavity 44. Of course, one skilled in the art will appreciate that a different number of contacts may be used without departing from the scope and intent of the present invention. The electrical contacts 72 are electrically connected to the electrical contacts 28 (through physical engagement) when the plug connector 22 is received in the receptacle connector 24. As previously stated, the receptacle connector 24 is formed at least partially from a flexible elastomeric material which at least partially encapsulates the electrical contacts 72.

To promote flexibility of the receptacle connector 24, and ease of make-up and disconnection of the connector assembly, the electrical contacts 72 are split rings (i.e. generally semi-circular) to permit expansion during the insertion and removal of the plug connector 22 into and out of the cavity 44 of the receptacle connector 24. Moreover, the electrical contacts 28, 72 of the plug connector and the receptacle connector have spherical surface portions whereby a spherical interface between the electrical contacts 28, 72 is formed upon make-up (see FIG. 4(*a*)). This spherical interface allows slight relative articulation between the electrical contacts which may result from flexure of the mated plug connector 22 and receptacle connector 24 while still maintaining a maximum of surface contact thereby reducing voltage drops between the electrical contacts. As perhaps best shown in FIG. 4, because the cavity 44 is dimensioned to matingly receive the plug connector 22, upon insertion of the elongated member 26 into the cavity, the peripheral surface 30 of the elongated member located between adjacent electrical contacts 28 sealingly engages the wall 70 to electrically isolate the adjacent electrical contacts from each other. It will also be appreciated that adjacent electrical contacts can be isolated from each other by a separate seal(s) (not shown) in the elongated member 26 between the adjacent electrical contacts.

Referring again to FIG. 3, the receptacle connector 24 further includes a fluid exhaust port 78 in fluid communication with the cavity 44. As indicated above, the proximal and distal seals 32 and 34 and the peripheral surface seal between adjacent electrical contacts 28 remove fluid or debris from the cavity and provide protection from fluid ingress and/or migration. As the elongated member 26 of the plug connector 22 is being inserted into the cavity 44 of the receptacle connector 24, the proximal seal 32 prevents and removes debris entrapment in the cavity by wiping the wall 70 defining the cavity. This, in turn, flushes any contaminants from the cavity through the exhaust port 78 prior to engagement of the electrical contacts 28 and 72.

Figure 5:
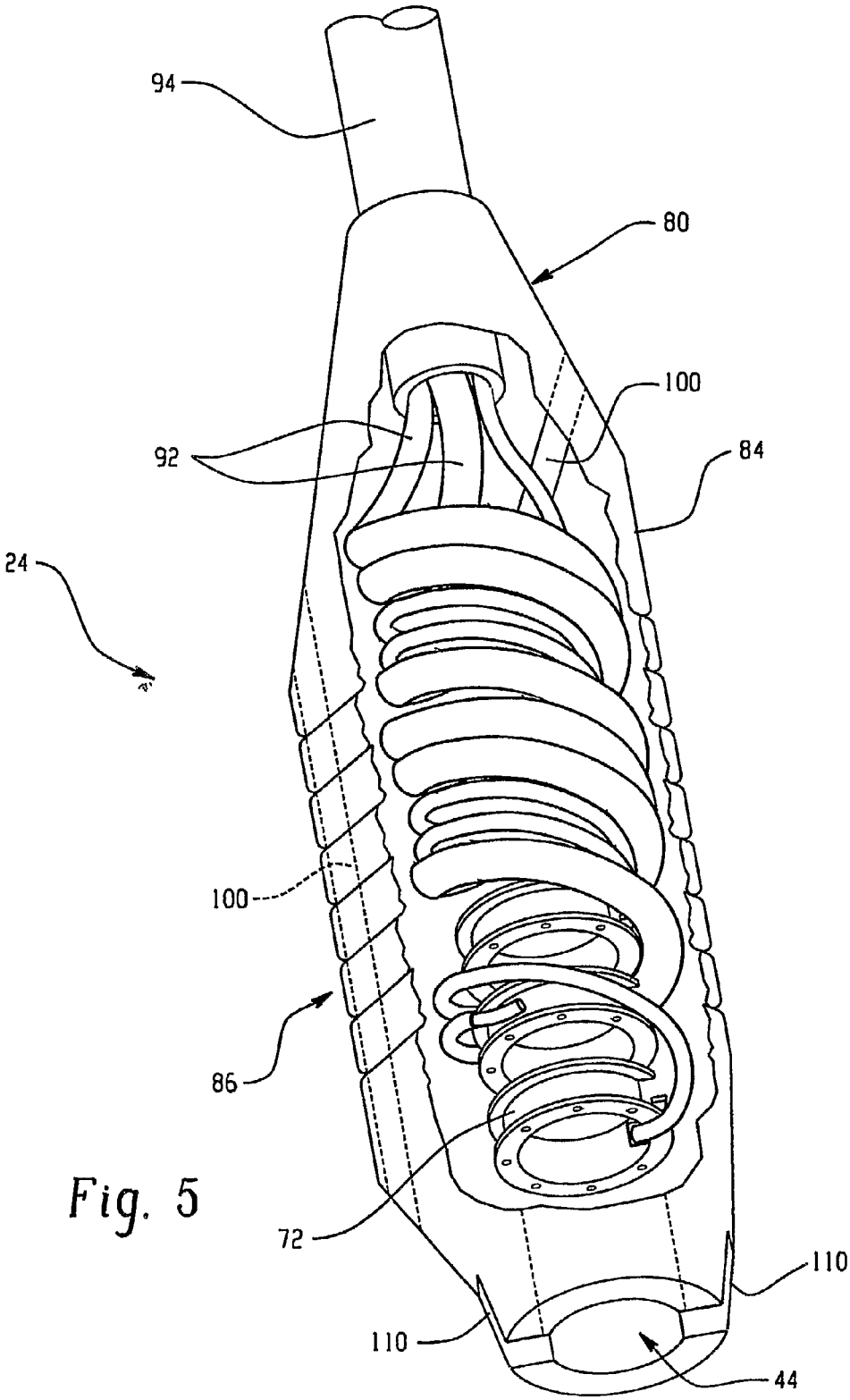
FIG. 5 is a perspective view of the receptacle connector of the connector assembly of FIG. 1 illustrating helically coiled power and signal/sensor cables.

Similar to the plug connector 22, and with continued reference to FIGS. 1-3, the receptacle connector 24 also includes a tapered strain relief 80. Again, the strain relief also adds flexibility to the receptacle connector and sealingly secures the receptacle connector to a second cable/cord jacket 82. Disposed on a peripheral surface 84 of the receptacle connector is a gripping means 86 generally comprised of a plurality of circumferentially extending ridges which allows for easy handling or manipulating of the receptacle connector 24, particularly during assembly and disassembly of the connector arrangement. The receptacle connector 24 includes a bore 90 for receiving a second set of power and signal/sensor cables 92 extending from an end of a cord 94. Each power and signal/sensor cable is electrically connected to one of the electrical contacts 72. The power and signal/sensor cables 92 extend longitudinally through the receptacle connector 24, the elastomeric material of the receptacle connector at least partially encapsulating the cables. As shown in FIG. 5, the second set of power and signal/sensor cables 92 are preferably helically coiled about the cavity 44 for flexibility and for relieving strain from solder joints between each cable and each receptacle contact 72. As will be appreciated, the helical portions of the cable will selectively uncoil and coil in response to forces imposed and released, respectively, on the connectors during make-up and disconnection. This reduces the probability that these forces are transferred to the solder joints that provide the important electrical connection between the individual cables and respective receptacle contacts.

In this embodiment, the connector assembly 20 is an in-line 5-channel flexible linear interconnect wherein each cord 64 and 94 has three power cables and two signal/sensor cables and is jacketed in a medical grade elastomeric material. The outer jackets 52 and 82 of the cords 64 and 94, respectively, are preferably an aliphatic polycarbonate-based polyurethane, for example sold under the trademark Carbothane® manufactured by Thermedics Polymer Products; although, it will be appreciated that other suitable elastomeric materials can be used for the jackets.

The receptacle connector 24 further includes a shaping member 102 (FIG. 4) extending therethrough which maintains a desired conformation of the connector assembly 20. The shaping member 102, which can be a bendable wire, provides the user with the ability to permanently shape the connector assembly depending on its end use. For example, bore 100 extends through the receptacle connector 24 for receiving the shaping member 102. Thus, the shaping member is easily inserted and removed if desired; although, it will be appreciated that the shaping member can be molded to or encapsulated by the elastomeric material of the receptacle connector.

Figure 4:
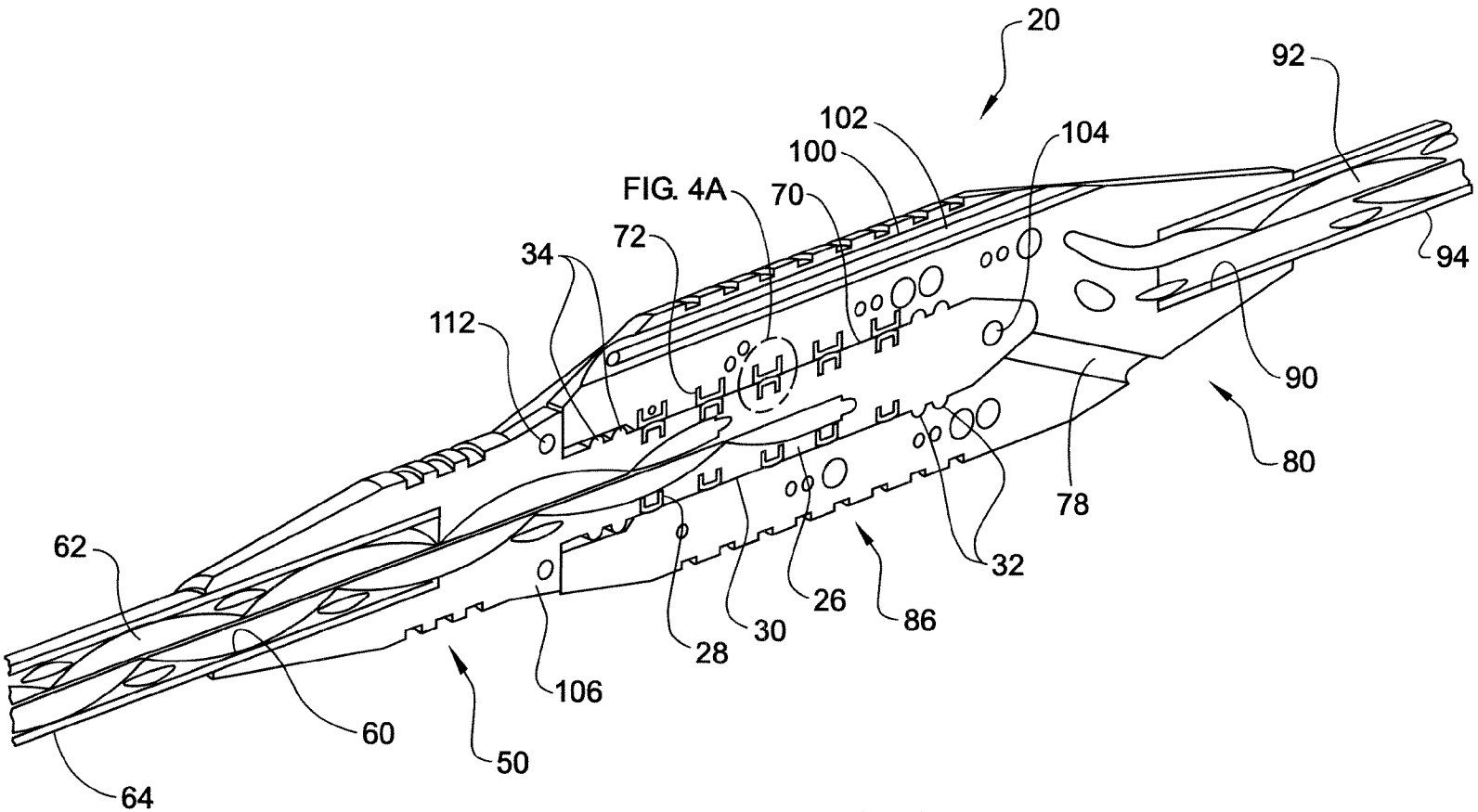
FIG. 4 is a cross-sectional view of the connector assembly of FIG. 1 illustrating the plug connector received in the receptacle connector.
Figure 4A:
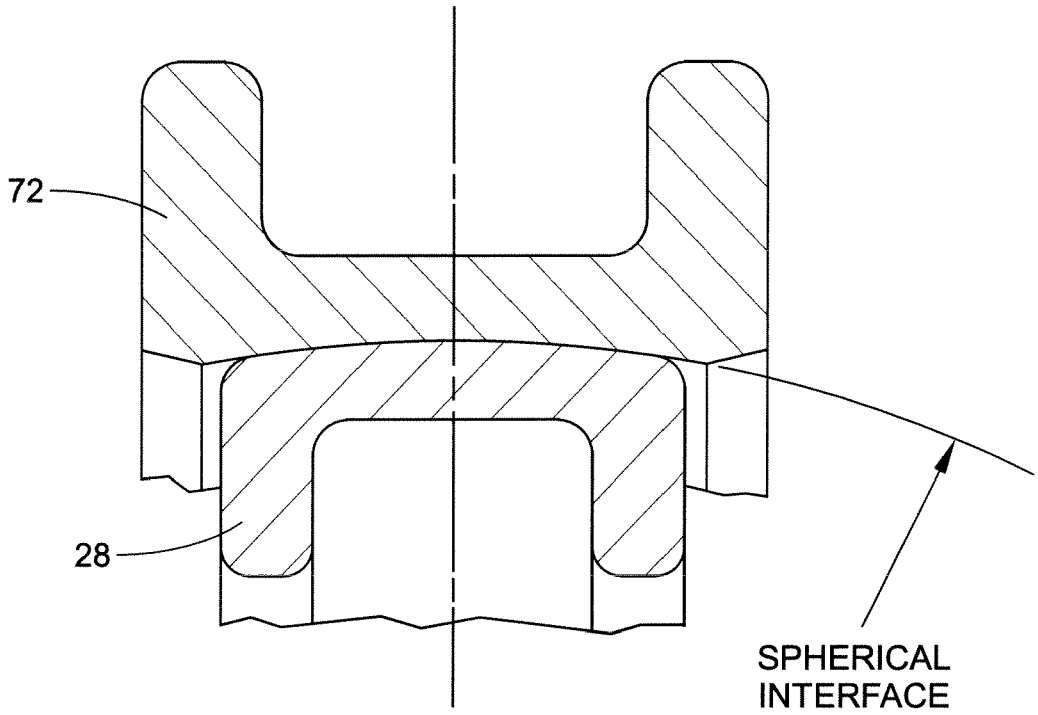

To connect the plug connector 22 to the receptacle connector 24, an end of the proximal portion 38 of the elongated member 26, which has a cone-like contour or tapered nose for ease of insertion and guiding receipt into the cavity 44 of the receptacle connector 24, includes a through hole 104 (FIG. 2). An end of a suture line (not shown) may be threaded through the hole 104 and knotted. An opposing end of the suture line is then threaded through the cavity 44 and the fluid exhaust port 78. As the suture line is pulled through the exhaust port, the cone-like end of the elongated member 26 enters the cavity 44. As the user continues to pull the suture line, the proximal seal 32 expels any fluid, air or debris in a cavity 44 out of the exhaust port 78 upon advancement of the plug connector 22 into the receptacle connector 24. As shown in FIG. 4, once the elongated member 26 is fully inserted in the cavity 44, electrical contacts 28 are connected to electrical contacts 72 and the peripheral surface 30 of the elongated member located between adjacent electrical contacts 28 sealingly engages the wall 70 defining the cavity 44 to electrically isolate the adjacent electrical contacts from each other.

Figure 6:
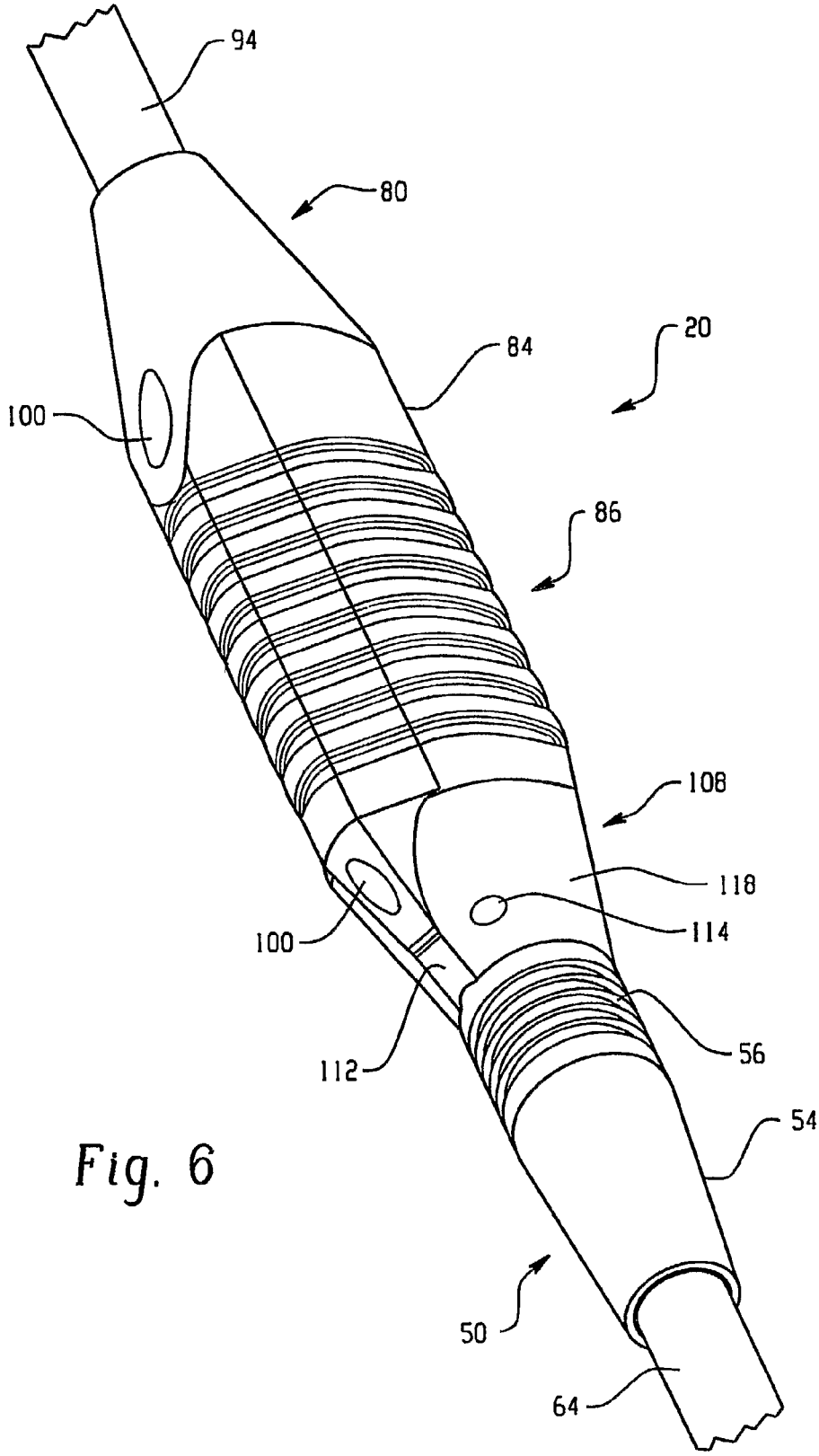
FIG. 6 is a perspective view of the connector assembly of FIG. 4.

As shown in FIGS. 1 and 2, the connector assembly 20 further includes a locking means for securing the plug connector to the receptacle connector. Specifically, the plug connector 22 includes a pair of diametrically opposed tabs 106 extending axially from an end of the strain relief 50 adjacent the distal seal 34. A proximal portion 108 of the receptacle connector 24 includes a slot 110 dimensioned to receive the tabs 106. The tabs have apertures 112 which register with apertures 114 extending through the proximal portions 108 such that a separate suture line (not shown) when threaded through the apertures secures the tabs in the slot. As shown in FIG. 6, once secured, the tabs 106 fully engage in the slot 110 which verifies correct assembly and the peripheral surface 54 of the strain relief 50 is contiguous with a peripheral surface 118 of the proximal portion 108. It should be appreciated, however, that the connector assembly 20 can include alternative locking means for securing the plug connector to the receptacle connector such as a twist lock, keyways and the like.

Similar to the aforementioned embodiment, a second embodiment is shown in FIGS. 7-13 Since most of the structure and function is substantially identical, reference numerals with a single primed suffix (') refer to like components (e.g., plug connector is referred to by reference numeral 22'), and new numerals identify new components in the additional embodiment of FIGS. 7-10.

Figure 7:
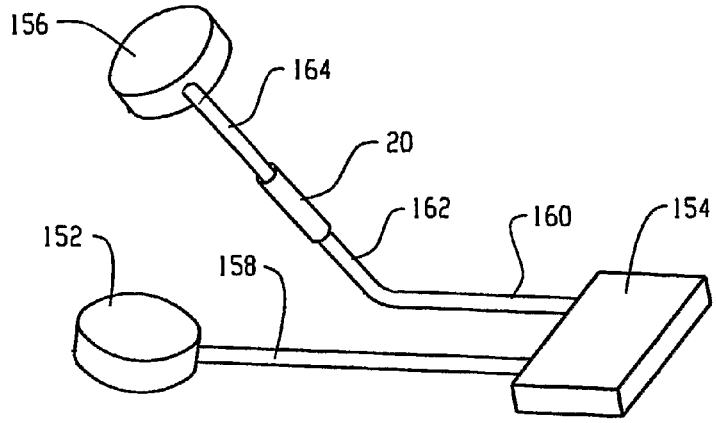
FIG. 7 is a perspective view of a typical wiring harness including a connector assembly in accordance with a second embodiment of the present invention.

With reference to FIG. 7, a typical wiring harness 150 includes a hard-wired battery 152, an electronic control unit 154 with a multiple bulkhead, and an actuator 156 with a bulkhead. A first cable or cord 158 interconnects the battery and the electronic control unit and a second cable or cord 160 interconnects the actuator and the electronic control unit. A connector assembly 20' separates the second cable into first and second sections 162 and 164, respectively.

Figure 8:
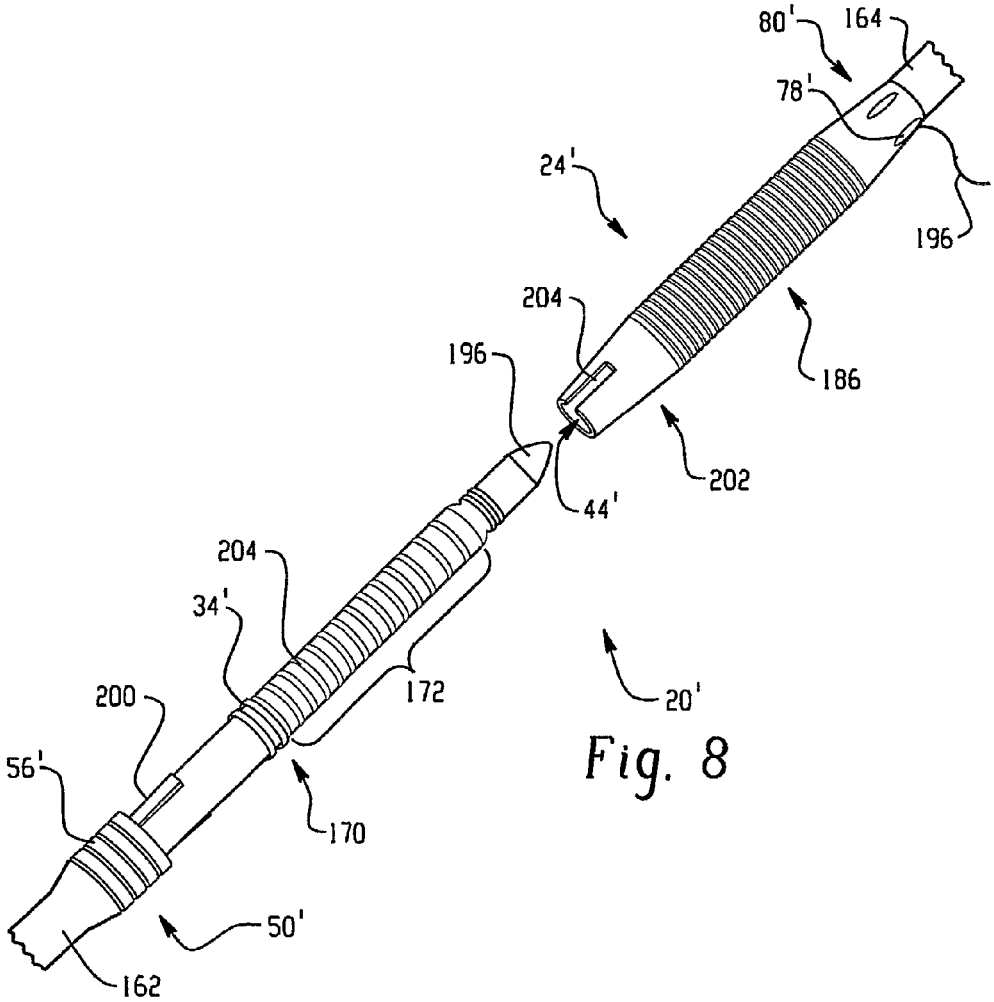
FIG. 8 is a perspective view of a plug connector and a receptacle connector of the connector assembly of FIG. 7.
Figure 9:
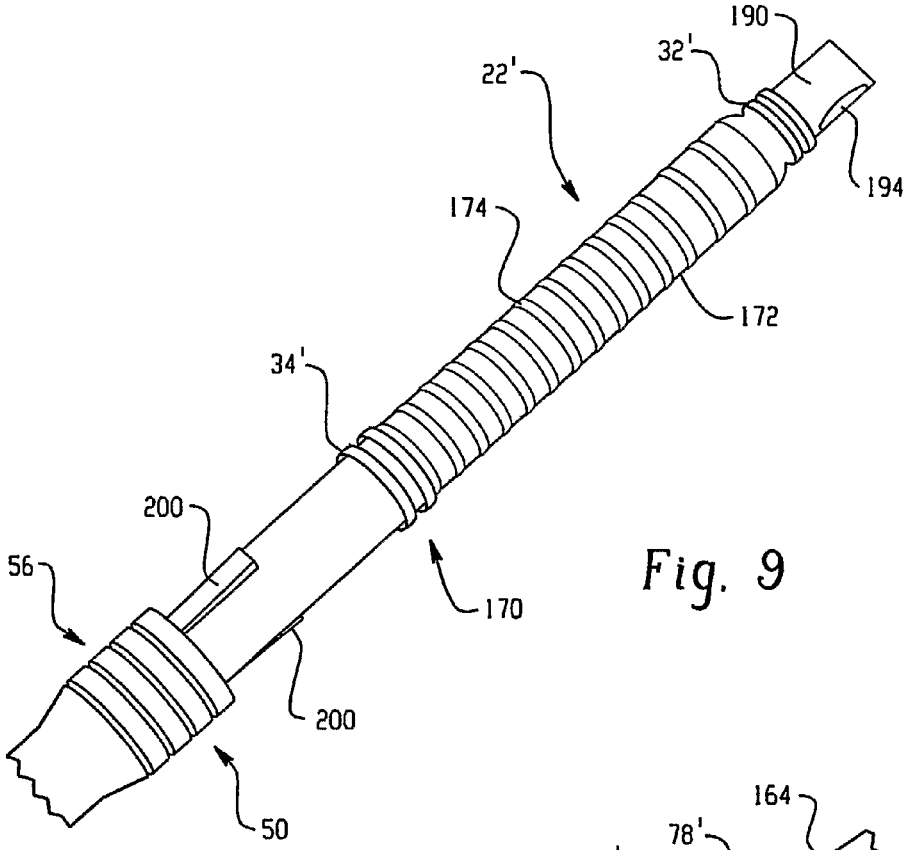
FIG. 9 is a perspective view of the connector assembly of FIG. 7 illustrating the plug connector received in the receptacle connector.
Figure 10:
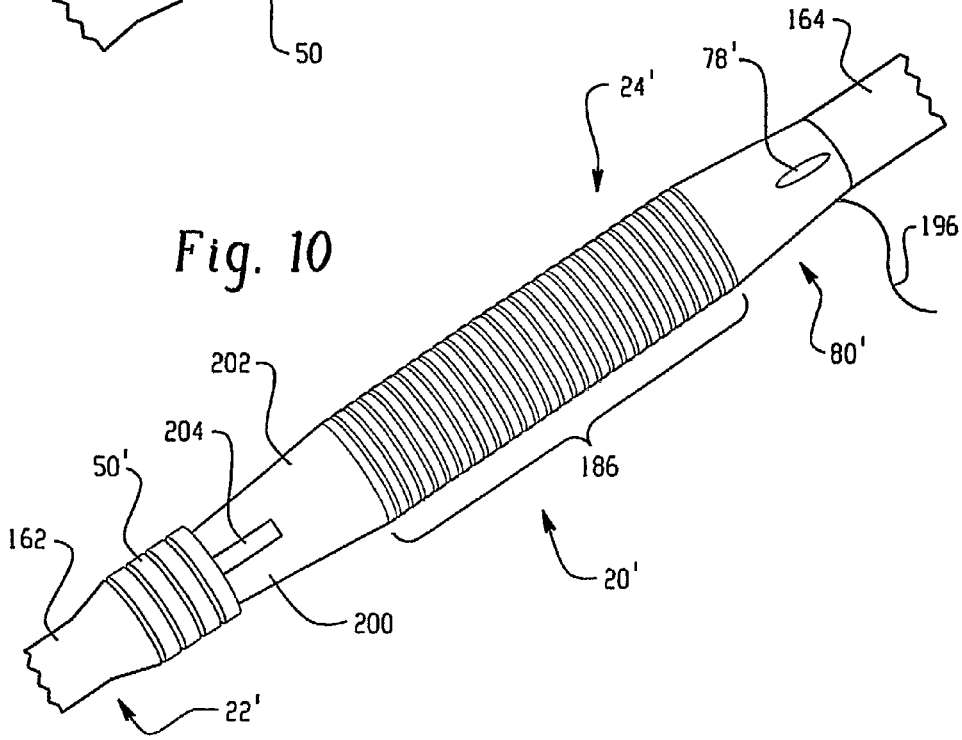
FIG. 10 is a perspective view of the plug connector of the connector assembly of FIG. 7.

As shown in FIGS. 8-10, the connector assembly 20' includes a plug connector 22' and a receptacle connector 24'. Similar to the first embodiment, both the plug connector and receptacle connector are formed at least partially from a flexible elastomeric material, preferably a medical grade elastomeric material.

The plug connector 22' includes an elongated member 170 and a plurality of linearly stacked, spaced apart electrical ring contacts 172 fixedly secured to a peripheral surface 174 of the elongated member. The plug connector 22' further includes a proximal seal 32' and a distal seal 34' axially spaced therefrom, both seals being fixedly secured to the elongated member 170. The proximal seal 32' expels any fluid or air in a cavity 44' of the receptacle connector 24' upon advancement of the plug connector 22' into the receptacle connector in a manner as described above. The distal seal 34' provides protection from fluid ingress and/or migration. In this embodiment, the proximal and distal seals are again shown as a pair of adjacent seals having O-ring conformations.

Adjacent the elongated member 170 is a tapered strain relief 50'. The strain relief sealingly secures the plug connector to the first section 162 of cable/cord 160 and adds flexibility to the plug connector 22'. The strain relief includes a gripping means 56' generally comprised of a plurality of ridges which allows for easy handling of the plug connector 22'. Although not illustrated, a first set of power and signal/sensor cables extending from an end of the first section 162 is electrically connected to the plurality of electrical contacts 172. The power and signal/sensor cables extend longitudinally through the elongated member 170, the elastomeric material of the elongated member encapsulating the cables.

With continued reference to FIGS. 8 and 10, the receptacle connector 24' includes the cavity 44' which, as stated above, is dimensioned to sealingly receive the elongated member 170 and a plurality of electrical contacts (not shown) having a surface disposed in a wall (not shown) of the cavity for electrical connection with the plurality of electrical contacts 172 of the plug connector 22' when the plug connector is received in the receptacle connector 24'. As previously stated, the receptacle connector 24' is formed at least partially from a flexible elastomeric material which at least partially encapsulates the electrical contacts.

To promote flexibility of the receptacle, and similar to the previous embodiment, the electrical contacts of the receptacle connector 24' are generally semi-circular to permit expansion during the insertion and removal of the plug connector 22' into and out of the cavity 44'. Because the cavity 44' is dimensioned to matingly receive the plug connector 22', upon insertion of the elongated member 170 into the cavity, the peripheral surface 174 of the elongated member located between adjacent electrical contacts 172 sealingly engages the cavity wall to electrically isolate the adjacent electrical contacts from each other. It will also be appreciated that adjacent electrical contacts can be isolated from each other by a separate integral seal(s) (not shown) formed with the elongated member 170 between the adjacent electrical contacts.

As shown in FIGS. 8 and 10, the receptacle connector 24' further includes a fluid exhaust port 78' in fluid communication with the cavity 44'. As indicated above, the integrally molded proximal and distal seals 32' and 34' and the peripheral surface seal between adjacent electrical contacts 172 remove debris and fluid from the cavity and provide protection from fluid ingress and/or migration. As the elongated member 170 of the plug connector 22' is inserted into the cavity 44', the proximal seals 32' prevent debris entrapment in the cavity by wiping the cavity wall, which, in turn, flushes any contaminants from the cavity through the exhaust port 78' prior to engagement of the electrical contacts.

Similar to the plug connector 22', the receptacle connector 24' also includes a tapered strain relief 80'. Again, the strain relief adds flexibility to the receptacle connector and sealingly secures the receptacle connector to the second section 164 of second cable/cord 160. Disposed on a peripheral surface 184 of the receptacle connector is a gripping means 186 generally comprised of molded-in ridges which aid handling of the receptacle connector 24' while wet. The receptacle connector includes a second set of power and signal/sensor cables (not shown) extending from an end of the second section 164 of second cable/cord 160. Each power and signal/sensor cable is electrically connected to one of the electrical contacts partially disposed in the cavity wall. The second set of power and signal/sensor cables extend longitudinally through the receptacle connector 24', the elastomeric material of the receptacle connector at least partially encapsulating the cables. Similar to the first embodiment, the second set of power and signal/sensor cables are helically coiled about the cavity 44' for flexibility and for relieving strain from solder joints between each cable and each receptacle contact.

With reference to FIGS. 8-10, to assemble the connector assembly 20', an end 190 of the elongated member 170 includes a through hole 194. An end of a suture line 196 is threaded through the hole 194 and knotted. An opposing end of the suture line is then threaded through the cavity 44' and the fluid exhaust port 78'. As the suture line 196 is pulled through the exhaust port, the end 190 of the elongated member 170 enters the cavity 44'. As the user continues to pull the suture line, the proximal seal 32' expels any fluid or air in a cavity 44' out of the exhaust port 78' upon advancement of the plug connector 22' into the receptacle connector 24'.

To secure the plug connector 22' to the receptacle connector 24', the plug connector includes a pair of diametrically opposed keys 200 extending axially from an end of the strain relief 50' adjacent the distal seal 34'. A proximal portion 202 of the receptacle connector 24' includes a slot 204 dimensioned to receive the keys 200. The keys have suture lock-wire through holes (not shown) which align with apertures (not shown) extending through the proximal portions 202 such that a separate suture line (not shown) is threaded through the holes and apertures to secure the keys 200 in the slot 204.

Figure 11:
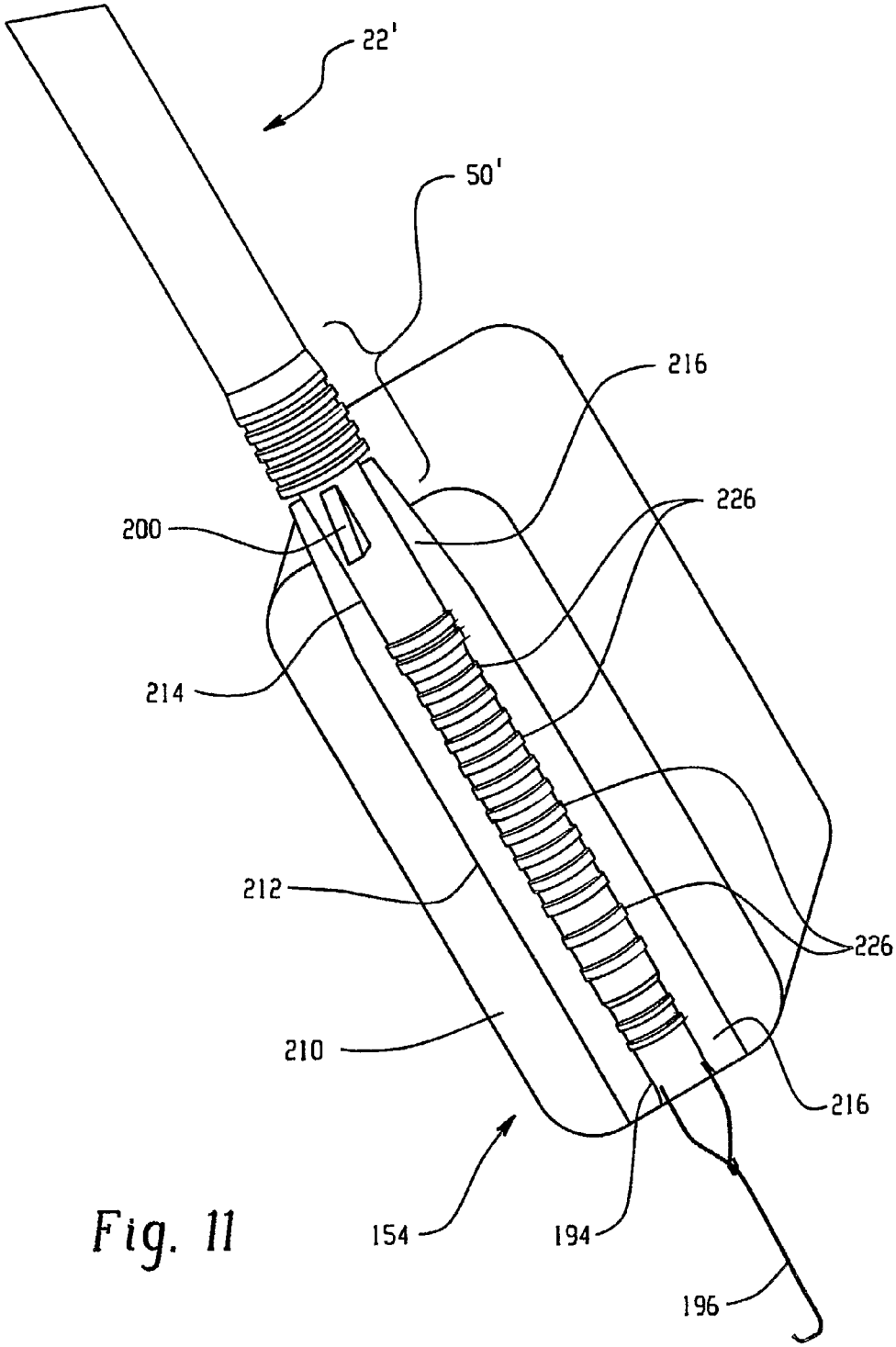
FIG. 11 is a perspective view, in partial cross-section, of the plug connector of FIG. 8 received in an electronic control unit of FIG. 7.
Figure 12:
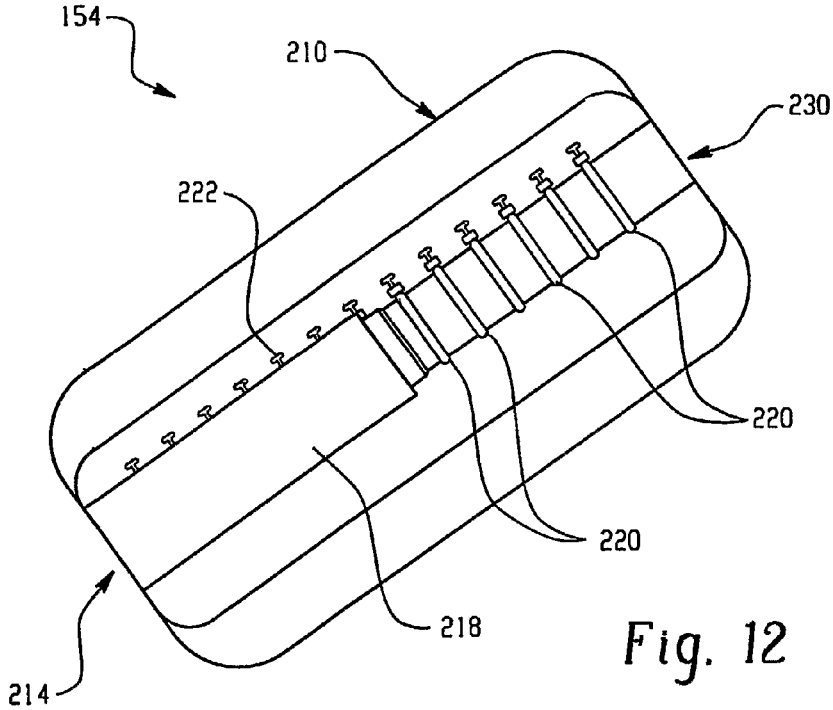
FIG. 12 is a perspective view, in partial cross-section, of the electronic control unit of FIG. 11.
Figure 13:
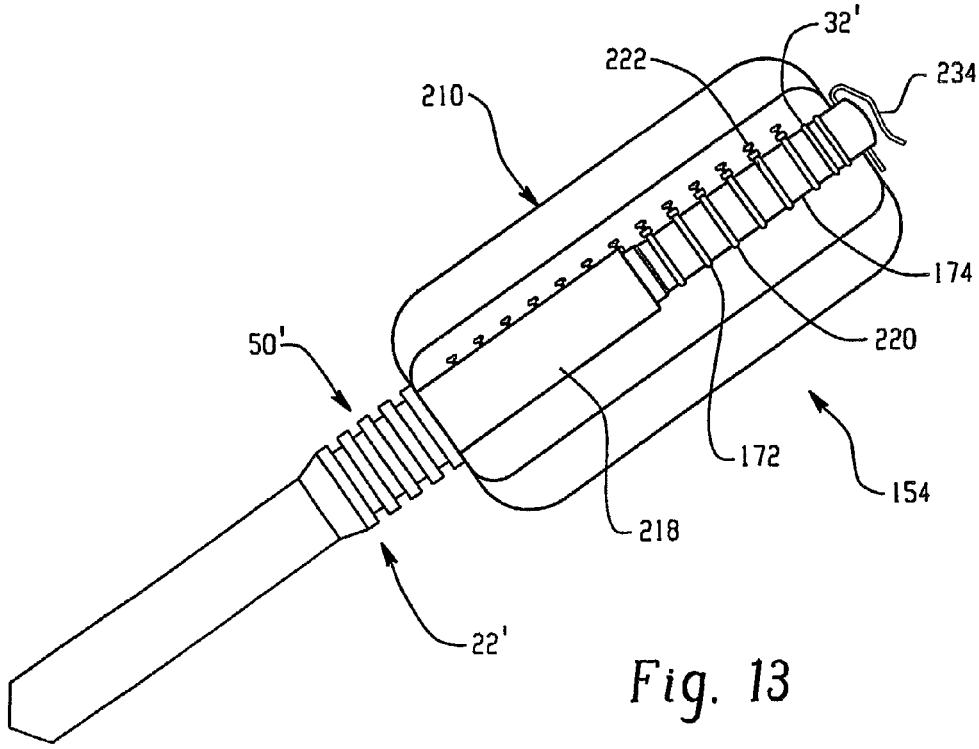
FIG. 13 is a perspective view, in partial cross-section, illustrating the plug connector of FIG. 8 received in the electronic control unit of FIG. 7.

With reference now to FIGS. 11-13, the connection of the plug connector 22' to the electronic control unit 154 is illustrated. The electronic control unit includes a titanium housing 210 having a wall 212 defining the cavity 214. In one embodiment of the electronic control unit 154, sealingly disposed within the cavity is an elastomeric receptacle 216 (FIG. 11) dimensioned to sealingly receive the plug connector 22'. The elastomeric receptacle has features similar to the receptacle connectors described above. In another embodiment of the electronic control unit 154, which is discussed in greater detail below, disposed within the cavity is a titanium shell 218 (FIGS. 12 and 13) dimensioned to sealingly receive the plug connector 22'.

The electronic control unit 154 includes at least one electrical contact 220 having a surface disposed in a wall of the shell for electrical connection with at least one electrical contact 172 of the plug connector. As shown in FIGS. 12 and 13, the longitudinally spaced apart electrical contacts 220 extend from the shell wall and at least partially surrounding the shell 218. Similar to the previous embodiments, the electrical contacts 220 are generally semi-circular. Moreover, the plurality of electrical contacts 172 of the plug connector 22' and the electronic control unit 154 have spherical surface portions whereby a spherical interface between the electrical contacts is formed upon make-up. This spherical interface allows slight relative articulation between the electrical contacts 172, 220 while still maintaining a maximum of surface contact thereby reducing voltage drops between the electrical contacts. Because the shell 216 is dimensioned to matingly receive the plug connector 22', upon insertion of the plug connector into the shell, the peripheral surface 174 of the elongated member located between adjacent electrical contacts 172 sealingly engages the shell wall to electrically isolate the adjacent electrical contacts from each other. Hermetically sealed pins 222 extend from a surface of the electrical contacts 220 through the shell 216 and are adapted to receive internal wiring, such as ribbon cable conductors 226 (FIG. 11).

As shown in FIG. 12, the electronic control unit 154 further includes an opening 230 in fluid communication with the cavity 214. As noted above, as the plug connector 22' is inserted into the shell, the integrally molded proximal seals 32' prevent debris entrapment in the shell by wiping the shell wall, which, in turn, flushes any contaminants from the shell through the opening 230 prior to engagement of the electrical contacts.

To assemble the plug connector 22' to the electronic control unit 154, the suture line 196 is threaded through the hole 194 located at the end 190 of the plug connector and is knotted. An opposing end of the suture line is then pulled through the shell 216 and the opening 230 thereby inserting the plug connector into the shell. As the user continues to pull the suture line, the proximal seal 32' expels any fluid or air in a shell out of the opening 230 upon advancement of the plug connector 22' into electronic control unit 154. Once fully inserted, the end 190 will extend partially out of the opening 230.

To secure the plug connector 22' to the electronic control unit 154, the keys 200 of the plug connector engage the shell which can include a slot (not shown) dimensioned to receive the keys. Moreover, a keeper 234 can be positioned in the hole 194 located at the end 190 of the plug connector.

As should be appreciated from the foregoing, because the connector assembly is flexible, there is not a severe rigid to flexible transition to cause problems with strain relieving. All electrical contacts are wiped as the connection is made, and any fluid or other contamination is extruded ahead of the proximal seals. The joints between power and signal/sensor cable leads and electrical contacts are distributed through the connector assembly, not concentrated on a terminal block, further improving strain relieving and reducing the risk of shorts or other failures.

The present disclosure has been described with reference to several embodiments. Obviously, modifications and alterations will occur to others upon reading and understanding the preceding detailed description. For example, it should be appreciated that the battery and the actuator for the wiring harness can have features similar to the electronic control unit for connecting same to a cable having a plug connector. It is intended that the disclosure be construed as including all such modifications and alterations insofar as they come within the scope of the appended claims or the equivalents thereof.

I claim:

1. A linear connector assembly comprising:

a plug connector including an elongated member, and an electrical contact disposed about a portion of the elongated member; and a receptacle connector including a wall defining a cavity dimensioned to sealingly receive the elongated member, and an electrical contact having a surface disposed in the wall for direct electrical connection with the plug contact;

wherein the electrical contacts of the plug connector and the receptacle connector have spherical surface portions whereby a spherical interface between the electrical contacts is formed upon make-up allowing slight relative articulation between the electrical contacts while still maintaining a maximum of surface contact thereby reducing voltage drops between the electrical contacts.

2. The invention of claim 1 wherein the plug connector is formed at least partially from a flexible elastomeric material.

3. The invention of claim 1 wherein the receptacle connector is formed at least partially from a flexible elastomeric material.

4. The invention of claim 3 wherein the elastomeric material at least partially encapsulates the electrical contact of the receptacle connector.

5. The invention of claim 1 wherein the plug connector includes a proximal seal and a distal seal axially spaced therefrom, the proximal seal being fixedly secured to a proximal portion of the elongated member, the distal seal being fixedly secured to a distal portion of the elongated member.

6. The invention of claim 5 wherein the proximal seal and the distal seal are integrally formed with the elongated member.

7. The invention of claim 1 wherein the receptacle connector further includes a fluid exhaust port in fluid communication with the cavity.

8. The invention of claim 1 wherein the receptacle connector further includes a shaping member extending therethrough for maintaining a desired conformation of the connector assembly.

9. The invention of claim 1 wherein the plug connector includes a bore for receiving first power and sensor cables, the first power and sensor cables being electrically connected to the plug contact.

10. The invention of claim 1 wherein the receptacle connector includes a bore for receiving second power and sensor cables, the second power and sensor cables being electrically connected to the receptacle contact.

11. The invention of claim 10 wherein the second receptacle power and sensor cables are helically coiled about the cavity and at least partially around the electrical contact for flexibility and for relieving strain from solder joints between each second cable and the receptacle contact.

12. The invention of claim 1 wherein a distal portion of the plug connector includes a tapered strain relief for flexibility and sealingly securing the plug connector to a first cable jacket.

13. The invention of claim 1 wherein a distal portion of the receptacle connector includes a tapered strain relief for flexibility and sealingly securing the receptacle connector to a second cable jacket.

14. The invention of claim 1 further comprising locking means for securing the distal portion of the plug connector to a proximal portion of the receptacle connector.

15. The invention of claim 1 wherein the receptacle connector includes a pin being in electrical contact with the receptacle contact, the pin being hermetically sealed for internal wiring.

16. The invention of claim 1 further including a titanium housing.

17. A flexible connector assembly comprising:

a plug connector including:

an elongated connector body, a plurality of longitudinally spaced apart first electrical contacts fixedly secured to a peripheral surface of the elongated connector body; and a receptacle connector including:

a wall defining a cavity dimensioned to matingly receive the plug connector, a plurality of longitudinally spaced apart second electrical contacts extending from the wall and at least partially surrounding the cavity, the plurality of second contacts being electrically connected to the plurality of first contacts when the plug connector is received in the receptacle connector;

wherein upon insertion of the elongated connector body into the cavity, the peripheral surface of the elongated connector body located between adjacent first contacts sealingly engages the wall to electrically isolate adjacent first contacts from each other, and wherein upon make-up, the connector assembly is flexible to a desired conformation and wherein an interface between each first contact and each second contact is generally spherical.

18. The invention of claim 17 wherein the plurality of first contacts are generally circular.

19. The invention of claim 17 wherein the plurality of second contacts are generally semi-circular.

20. The invention of claim 17 wherein the plug connector further includes a proximal seal and a distal seal, the proximal seal expelling any fluid or air in the cavity upon advancement of the plug connector into the receptacle connector.

21. The invention of claim 17 wherein the receptacle connector further includes an exhaust port in fluid communication with the cavity.

22. The invention of claim 17 wherein the receptacle connector further includes a bore for receiving a shaping member for maintaining a desired conformation of the connector assembly.

23. The invention of claim 17 wherein the plug connector includes means for pulling the elongated connector body of the plug connector into the cavity of the receptacle connector.

24. The invention of claim 17 further comprising means for locking the plug connector to the receptacle connector.

25. A linear connector assembly comprising:

an elongated plug connector including:

a first bore for at least partially receiving therein a first set of external power and sensor cables, and a plurality of spaced apart first electrical contacts received therein, wherein the first set of power and sensor cables are electrically connected to the plurality of first electrical contacts; and a receptacle connector including:

a cavity dimensioned to sealingly receive the elongated plug connector, a plurality of second electrical contacts received therein, the plurality of second contacts being electrically connected to the plurality of first contacts upon assembly of the plug connector to the receptacle connector, and a second bore for at least partially receiving therein a second set of external power and sensor cables electrically connected to the plurality of second electrical contacts wherein the second set of receptacle power and sensor cables are helically coiled about the cavity for flexibility and for relieving strain from solder joints between each second cable and each second electrical contact and wherein upon insertion of the elongated plug connector into the cavity, the elongated plug connector sealingly engages a wall defining the cavity to electrically isolate adjacent first electrical contacts.

* * * * *